US012672709B2

(12) United States Patent
Gimenez

(10) Patent No.: US 12,672,709 B2
(45) **Date of Patent: *Jul. 7, 2026**

(54) APPARATUS FOR CONNECTED HAIR PIGMENT DISPENSER

(71) Applicant: YUV Beauty, Inc., Sherman Oaks, CA (US)

(72) Inventor: Francisco Gimenez, London (GB)

(73) Assignee: YUV Beauty, Inc., Sherman Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/978,494

(22) Filed: Dec. 12, 2024

(65) Prior Publication Data

US 2025/0107612 A1 Apr. 3, 2025

Related U.S. Application Data

(63) Continuation of application No. 18/439,872, filed on Feb. 13, 2024, now Pat. No. 12,193,559, which is a continuation of application No. 18/226,301, filed on Jul. 26, 2023, now Pat. No. 11,918,098, which is a continuation of application No. 18/099,849, filed on Jan. 20, 2023, now Pat. No. 11,751,666.

(Continued)

(51) Int. Cl.
*B65D 83/16* (2006.01)
*A45D 44/00* (2006.01)

(52) U.S. Cl.
CPC ..... *A45D 44/005* (2013.01); *B65D 83/16* (2013.01)

(58) Field of Classification Search
CPC ..... A45D 44/005; B01F 2101/21; B01F 35/2117; B65D 83/46
See application file for complete search history.

(56) References Cited

U.S. PATENT DOCUMENTS 7,185,789 B2 * 3/2007 Mink ..... B01F 35/882 222/135
12,193,559 B2 * 1/2025 Gimenez ..... B65D 83/262
(Continued)

FOREIGN PATENT DOCUMENTS

WO 2019204521 A1 10/2019

OTHER PUBLICATIONS

European Application No. 23743969.0, Extended European Search Report mailed Jul. 8, 2025, 7 pages.

*Primary Examiner* — Jason K Niesz
(74) *Attorney, Agent, or Firm* — White and Williams LLP

(57) ABSTRACT

The present invention is directed to a Hair Pigment Dispensing ("HPD") device that may be connected to the internet and intended for professional hairstylists to prepare their hair color formulations. Hair dying is a process that can take several hours and requires precise measurements, high attention to detail, and informed decision making. Not to mention, hair dying requires a large inventory of products to be readily available to the hairstylist. The present invention aims to decrease errors in product measurement, inventory size, and time spent mixing hair color ingredients to improve the overall experience for both the hairstylist and the client. Furthermore, the present invention provides the advantage of storing data from various client mixtures either locally or within a cloud server so that a customer can receive uniform coloring.

16 Claims, 21 Drawing Sheets

Related U.S. Application Data

(60) Provisional application No. 63/301,560, filed on Jan. 21, 2022.

(56) References Cited

U.S. PATENT DOCUMENTS

| | | | | |
|---|---|---|---|---|
| 2006/0033907 | A1* | 2/2006 | Inzinna ..... | G01J 3/46<br>356/45 |
| 2019/0320777 | A1 | 10/2019 | Macedo et al. | |

* cited by examiner

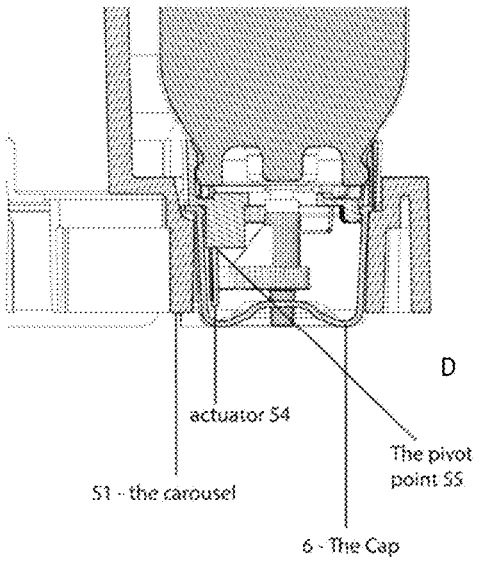
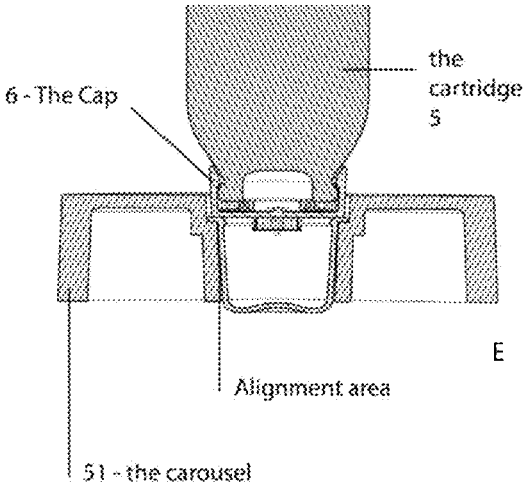
FIGURES 5D-E

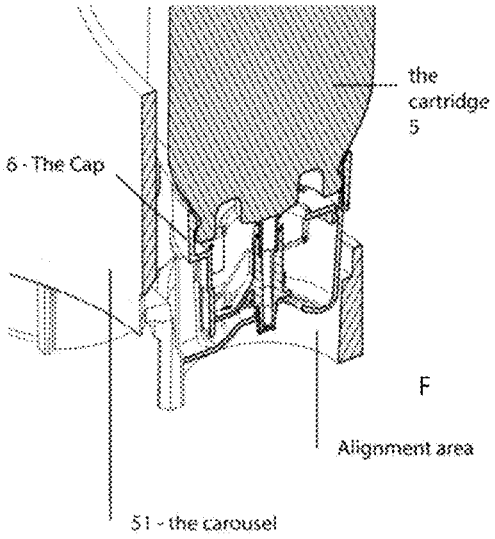
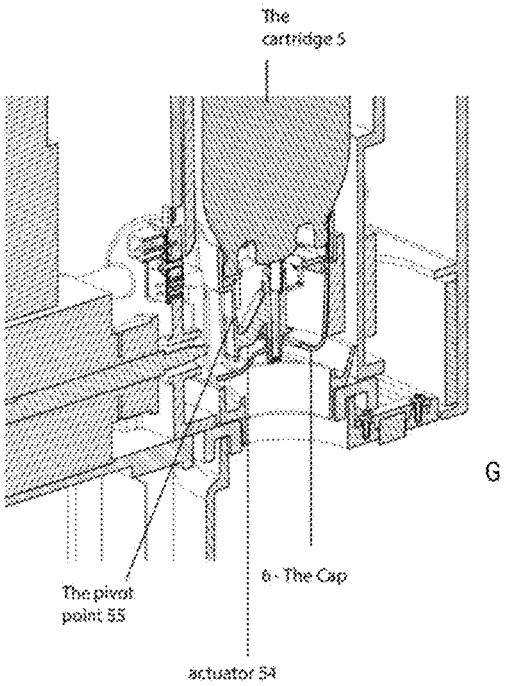
FIGURES 5F-G

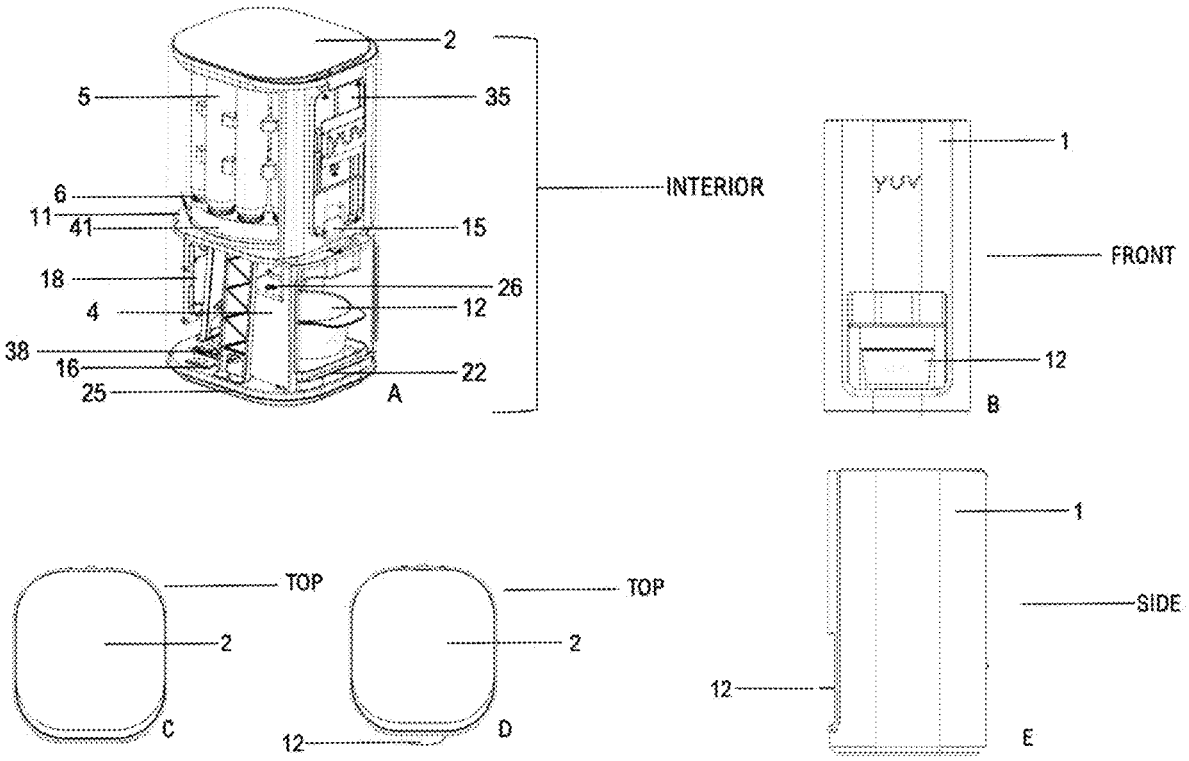
FIGURES 6A-E

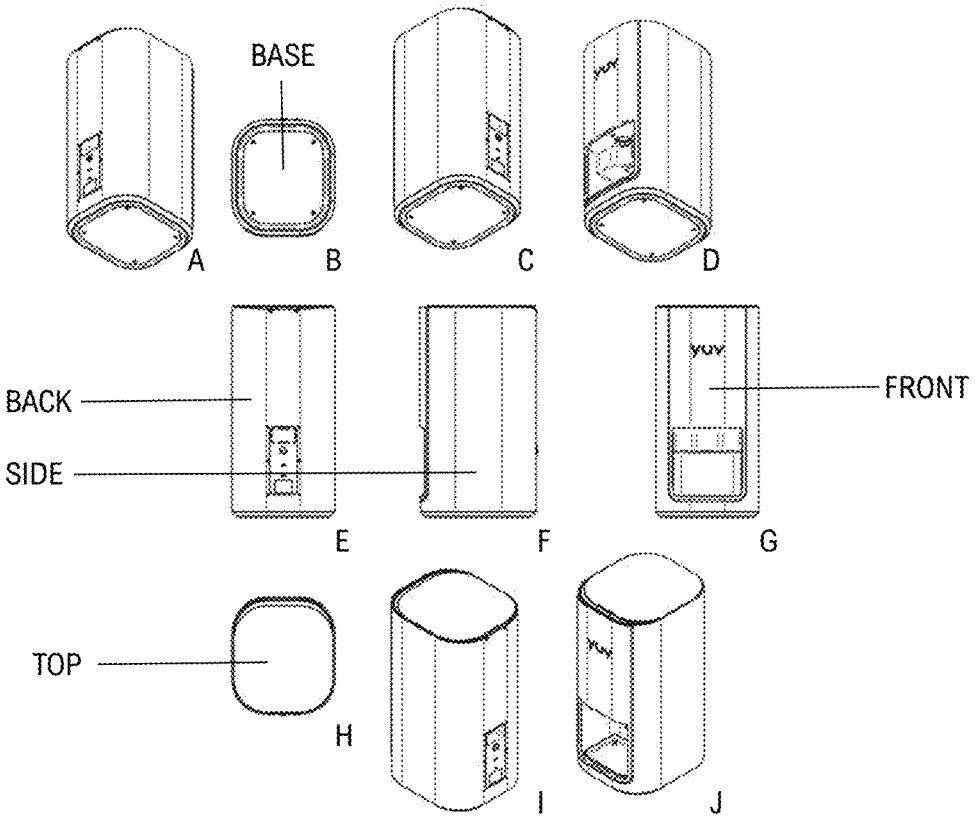
FIGURES 9A-J

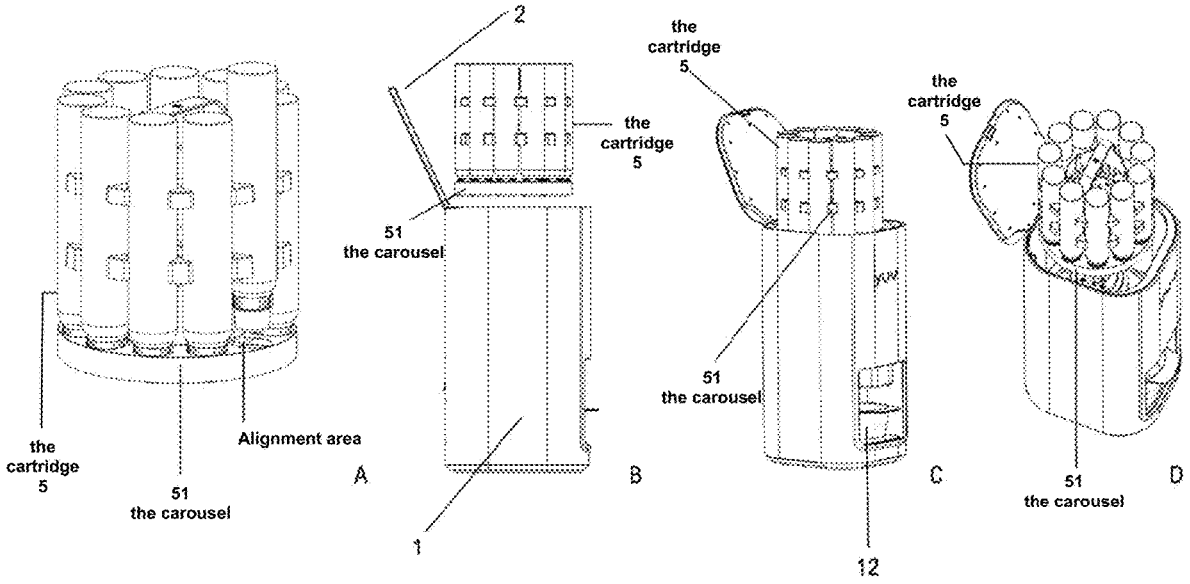
FIGURES 12A-D

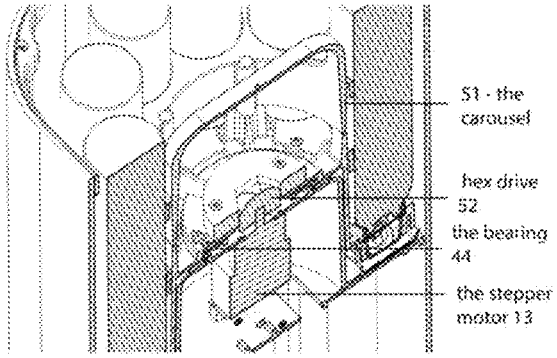
A
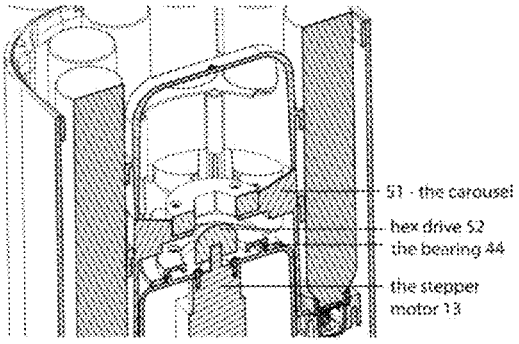
B
FIGURES 13A-B

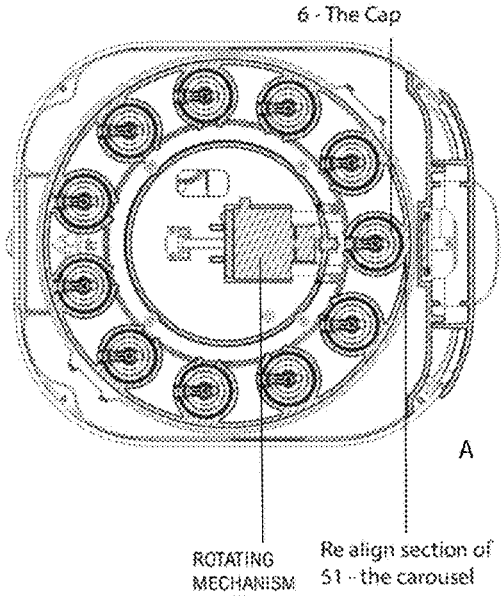
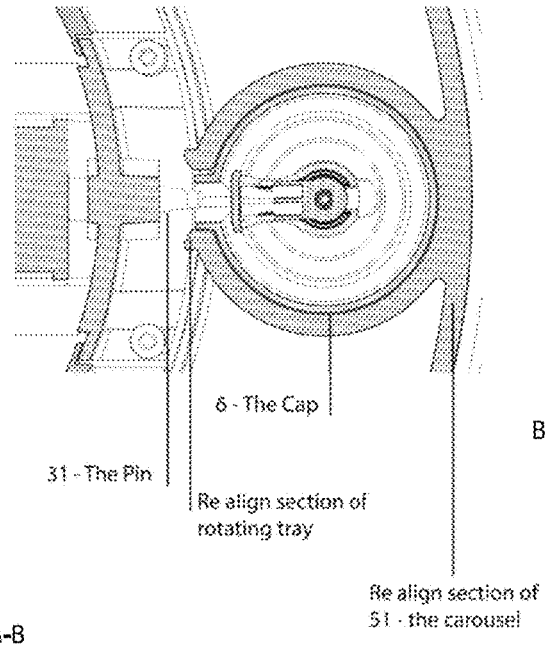
FIGURES 14A-B

APPARATUS FOR CONNECTED HAIR PIGMENT DISPENSER

CROSS REFERENCE TO RELATED APPLICATIONS

This application is a continuation of U.S. patent application Ser. No. 18/439,872, filed Feb. 13, 2024, now U.S. Pat. No. 12,193,559, which is a continuation of U.S. patent application Ser. No. 18/226,301, filed Jul. 26, 2023, now U.S. Pat. No. 11,918,098, which is a continuation of U.S. patent application Ser. No. 18/099,849, filed Jan. 20, 2023, now U.S. U.S. Pat. No. 11,751,666, which claims the benefit of U.S. Provisional Patent Application Ser. No. 63/301,560, filed Jan. 21, 2022, the full disclosures of which are hereby incorporated by reference in their entireties.

BACKGROUND OF THE INVENTION

The present invention is directed to a Hair Pigment Dispensing ("HPD") device that may be connected to the internet and intended for professional hairstylists to prepare their hair color formulations. Millions of people across the world color their hair. This is a common service offered in hair salons everywhere. The process begins with a consultation between a hairstylist and their client to determine what the client wants and the best way to provide their requests. After the consultation, the hairstylist decides which formula to prepare in order to obtain the desired results. The success of this process depends on the expertise of the hairstylist deciding the best formula and on the correct measuring of the ingredients required for such color. In theory, a hairstylist should keep notes of every formulation and measure each ingredient required using a scale. In practice, this does not always occur.

The world of hair color is divided into four main categories: permanent dyes, demi-permanent dyes, semi-permanent dyes, and bleachers or lighteners. The permanent and demi-permanent options are oxidative dyes that require mixing the hair color with a hydrogen peroxide solution to activate the color reaction. The hydrogen peroxide solution is commonly referred to as "developer." From an ingredient perspective, the main difference between permanent and demi-permanent hair dyes is that permanent hair dyes contain higher concentrations of alkalizers, which open the hair cuticle to allow for deeper penetration of the dye. As a result, permanent colors deposit more effectively into the hair and consequently last longer and provide better gray coverage than demi-permanent hair dyes. For the most part, one of the most effective alkalizers used in hair coloring is ammonia, however substitutes are commonly found in ammonia-free hair dyes such as ethanolamine. For the most part, the ingredients used in permanent and demi-permanent hair dyes are very similar and are simply used in different concentrations (such as higher or lower alkalinity or higher or lower pigment load).

Permanent and demi-permanent hair dyes are offered in liquid or cream consistencies, however most hair dyes on the market are provided in a cream form. Permanent and demi-permanent colors are used to achieve natural looking colors and to provide gray hair coverage. Permanent hair dyes can also be used to lighten hair color depending on the level of alkalinity and on the concentration of hydrogen peroxide solution used to mix the color. The higher the concentration of hydrogen peroxide in the developer the higher the level of lightening. Permanent hair dyes are commonly mixed in equal parts with a solution that contains a 6% concentration of hydrogen peroxide (20 volume), and demi-permanent hair dyes are mixed with a solution that contains a 3% concentration of hydrogen peroxide (10 volume).

Semi-permanent hair colors do not require the oxidation process to work and can be applied directly into the hair. The pigments used in this type of hair color are called "direct dyes" and they are different from those used in oxidative dyes. Semi-permanent hair dyes do not penetrate the hair and mostly sit on the surface of the hair. They provide temporary results and depending on the concentration of pigments they could fade in a week to a month. Semi-permanent dyes are the ones used to achieve intense, bright fashion shades such as neon and pastels. The last category of dyes are bleachers or lighteners that do not actually color the hair but do the opposite, they remove color. This category normally works when combining a bleaching agent either in cream or powder form with a solution of hydrogen peroxide. It is common for hair color brands intended for professional use to have an offering of more than fifty shades per type of color line (permanent, demi-permanent, and semi-permanent). As a result, it becomes a considerable inventory investment for a hairstylist to have a full catalog of products for each color line while also to considering a larger inventory for the most frequently used colors in stock.

The most common use of hair coloring is to cover gray hair and to restore the hair to its natural shade. Hair dyes are a unique medium in that they process differently depending on the type of hair upon which they are applied. For example, the same "medium brown" hair dye could look completely different on two people whose hair has different characteristics. It is for this reason that hair coloring has historically been the most difficult task for a hairstylist, leading to the development of hairstylist experts who specialize in coloring hair (professionally referred to as "colorists"). In a survey, only 59% of hairstylists expressed being completely comfortable doing hair color applications. To achieve the right shade, an expert colorist must take into consideration factors such as natural hair color, previously dyed hair color, hair texture, hair porosity and quantity of gray hairs as well as the client's desired color post-dye. There are also rules of formulation that affect the reaction on previously colored hair versus uncolored hair.

A hair color formula or recipe commonly consists of at least two different colors in specific proportions to be mixed with a specific developer strength. Normally, hairstylists prepare two ounces of hair dye blended with two ounces of developer. As an example, a hairstylist maty mix one ounce of Dark Brown, half an ounce of Medium Brown, and half an ounce of Golden-Brown with two ounces of 20 volume developer (6% hydrogen peroxide concentration). After a hairstylist has ideated the right formula for a client, the mixing process begins. First, each component (hair colors and the developer) required by the formula must be obtained and measured accurately. Following the previously mentioned example, the hairstylist would need to find tubes of Dark Brown, Medium Brown, and Golden-Brown hair color and the 20-volume developer and then precisely measure each component as required by the formula. In a survey, only approximately 44% of hairstylists measure their color by weight which is the most precise form of measurement.

The client and the hair stylist relationships are normally more important than the relationship between the client and the salon. It is common for clients to follow their hairstylist whenever they decide to move to a new location. With the advantage of smartphones and other technologies, the salon industry has been changing rapidly as hairstylists can now individually perform most of the tasks that were previously only handled by salons such as marketing, booking appointments, and charging credit cards. As a result, there are more independent hairstylists today than those employed by salons. By some estimates, 55% of hairstylists are self-employed and work either renting a booth at salon or at a salon suite. As a result, self-employed hairstylists must depend on themselves to secure their own supplies such as hair dyes and finance their own inventory. Many self-employed hairstylists make multiple visits a month to the beauty supply store in order to minimize the impact of investing in too much inventory.

SUMMARY OF THE INVENTION

The present invention pertains to a system and method for a Hair Pigment Despenser ("HPD"). The HPD helps hairstylists by automatically preparing any desired hair color formula accurately and quickly, while maintaining formulation records and keeping track of inventory usage to help with the process of restocking. In fact, the RFID tags associated with each cartridge cap allows the contents of each cartridge to be closely monitored by system of the present invention, allowing for automatic shipments of new cartridges to be set up and received before the hairstylist is even aware that any cartridges are running low, thus eliminating the stress of restocking all together. It will be understood that the present invention is not limited to hair color and may be used to dispense other beauty products.

In the primary embodiment, the present invention can be interacted with physically via a touchscreen or remotely via voice command or a wirelessly paired device such as a smartphone or computer. The presence of both a speaker and a microphone allow for audio features and audio interaction. In the simplest terms, the HPD receives a request from the hairstylist, determines the required amount of each product based on the request, and prepares the formula that will achieve the desired result.

All the necessary ingredients for various hair color combinations and dye-types are contained within the present invention in traditional, pressurized aerosol consists with a valve that releases the contents under pressure upon activation of such valve. The HPD and hair pigment cartridges ("HPCs") and cap are designed so that they may work exclusively with each other. The cap can translate the horizontal movement into vertical movement on the valve of the aerosol can. In one embodiment, the present invention contains a QR code label that comes from a printer associated with the present invention. In other embodiments, the QR code is replaced by a liquid paper LCD display. The purpose of the QR code or the liquid paper LCD display is to identify the contents of each cartridge to identify inventory levels, ownership of the cartridge, and other label-based functions.

One of the basic premises of this invention is that the number of ingredients required to prepare hair color formulations can be dramatically reduced. This is because the present invention operates like an inkjet printer, which relies on only 4 colors (cyan, magenta, yellow, and black) to produce any desired color. In the present invention, a combination of primary colors (red, yellow, and blue) together with basic neutral shades (black, brown, blonde) mixed in precise ways can provide millions of potential color combinations on demand. Another advantage of on-demand color mixing provided by the present invention is that it alleviates the need for excessive inventory of individually packaged, pre-made hair colors. The present invention can also create various levels of permanent dyes. For example, the present invention can mix both permanent and demi-permanent versions of the same colors) by simply adjusting the amount of ammonia (or other alkaline agent) on demand in order to achieve the desired result. In the case of oxidative dyes, the base ingredients required will be formulated as traditional demi-permanent colors with an additional, separate alkalinity booster. The HPD can also prepare the correct hydrogen peroxide measurement needed.

The HPD may operate without any pumps or tubes that could become clogged, fail to function, or leak. The dispensing happens from the HPC into the receiving bowl used for application on the client's hair. Once the HPD has identified the converted formula into specific ingredients and amounts required of each of them, it activates a stepper motor that rotates the tray that holds the HPCs in order to position the correct ingredient above the hair coloring bowl which sits atop a scale. The scale measures the amount of each ingredient dispensed. It should be noted that the terms "HPC," "hair pigment cartridges," "cartridges," and "pigment cartridges" all refer to the same feature of the present invention and may be used interchangeably.

Once it is in the correct dispensing position, the HPC may be activated when a linear stepper motor is energized with an electric charge, the servo pushes a pin up into the cap through a small opening (in one embodiment, the opening is approximately 3-5 mm in diameter). This pushes a built-in mechanism which activates the valve inside the HPC. Upon movement, the valve releases the ingredient contained in such cartridge and dispenses it into the bowl. The dispensing stops once the scale has measured that the right amount of each ingredient has been provided. This mechanism is illustrated in detail in FIG. 5 of appendix A and appendix B. To stop the dispensing, the controller halts the flow of electricity to the linear stepper motor, thus removing the push force allowing the pin to return to its initial state.

In alternative embodiments, the function of the scale may be replaced by or paired with a timer mechanism that uses the length of time of dispensing the product as a measurement for how much product has dispensed, in the same way that household coffee machines use time to determine how much water is dispensed and how "strong" the brewed coffee is. Alternatively, the scale may be replaced by or paired with a spectrophotometer, which records data regarding the absorbed light versus the non-absorbed light from a sample color as a reference. This data is then sent to software that converts the recorded wavelengths of light into a formula for pigment dispensing in order to produce the same color as the sample provided.

In the preferred embodiment, the control printed circuit board ("PCB") provides electrical energy to the linear stepper motor, which allows the motor to operate and push a pin forward into the cap of a HPC. The linear stepper motor has a threaded shaft, allowing it to convert rotary movement into linear movement. Furthermore, the use of a linear stepper motor allows for precise operation of the pin. Rather than a simple open and close mechanism, the linear stepper motor provides the ability to control the speed of movement of and the distance travelled by the actuator pin. This design allows for enhanced precision when it comes to dispensing the correct amount of each product from the cartridges.

In order to ensure that the cap closes when the exact amount of product needed has been dispensed, the cell load or high-precision scale located within the tray below the mixing bowl is connected to the PCBs. Once the desired weight of product is detected, the scale relays this to the PCBs which stop the flow of current to the linear stepper motor, thus pulling back the pin and closing the valve within the cap to end the flow of product to the bowl. The RFID associated with each cartridge cap communicates with the PCB to ensure that the correct product is being dispensed and can inform the system if the product has reached a low level within the cartridge and requires refilling. To ensure that no product is dispensed without the presence of the bowl, a camera capable of scanning the QR code on the bowl detects the presence of the receptacle. If no receptacle is present, the PCB is prevented from sending electrical current to the linear stepper motor, and no product is dispensed.

To correctly position the different ingredients to be dispensed, the tray may contain a Zero Position Indicator ("ZPI"), which may be a small magnet. The HPD has a Position Sensor ("PS") in a fixed position that reads the ZPI or magnet when in close proximity. The software that powers the HPD can record the tray position when the sensor makes contact and label it as position Zero and use it as a reference so that the stepper motor can perfectly position the tray in any target position for each ingredient dispensed.

In one embodiment, the tray holding the HPCs may be removable rather than fixed to the HPD in order to easily switch the type of ingredients used. For example, a hairstylist could remove at once the tray that holds oxidative HPCs and place into the HPD another tray already loaded with semi-permanent (direct) dyes rather than removing one of them at a time. Furthermore, the HPD may contain a controller with Wi-Fi and Bluetooth connectivity along with embedded software that manages the interaction with the hairstylist of the device and how those instructions translate into operations performed by the different electronic components. The HPD may have an active but intermittent internet connection either directly or through a smartphone to sync data to the cloud to help with the inventory controls and for cloud supported features.

In the primary embodiment, the present invention is enabled with internet and Bluetooth connection capabilities. A PCB located within the present invention and shown in FIG. 7 (38) provides sufficient connectivity so that various data can be stored, accessed, and used as input for color formulation recipes. In some embodiments, the control PCB and all other PCBs contained within the present invention may contain a microprocessor. This microprocessor may play several roles, including but not limited to connecting with and providing power to the linear stepper motor to dispense product, storing and retrieving data from a secure cloud network space, and connecting with the several other PCBs contained within the present invention and/or within separate units of the present invention in order to coordinate the flow of the system. Instructions for the formation of the desired color may be given to the present invention via the hairstylist's input, or via data from an external or internal database. The PCB enables internet connection, providing the present invention with the ability to store and access data in cloud-based storage.

Should a hairstylist have data regarding all their previous hair dye recipes, this information may be uploaded to the present invention via Bluetooth, USB insert, or other methods, allowing the present invention to access the used recipes and recreate the same colors previously created by hand by the hairstylist. The ability of the present invention to store and access data regarding previously desired hair colors allows customer files to be stored to provide each customer with the opportunity of receiving the same hair color mixture from various salons or hairstylists equipped with the present invention regardless of location or time.

Several units of the present device can also be connected for synchronized use of multiple systems within a salon setting. This provides the advantage of sending and receiving input via a cloud network from one "controller" device that may be a single system of the present invention, or an independent user interface such as the website or app accessed via a wireless interface which in turn assigns tasks accordingly to several other units in order to complete several different batches of hair color at once.

The present invention may also be integrated with a website and/or app on which hairstylists and clients can create profiles that are accessible to the present invention. Upon creating a profile, the user may be prompted to input their status as either a "hairstylist" or a "client" in order to categorize the user into the appropriate interface format. For hairstylists, the app or website allows for remote calibration of the present invention to ensure that each cartridge is dispensing the appropriate amount of product based on the pigment it contains and to ensure no errors will occur prior to mixing a desired color. Furthermore, hairstylists can access data regarding their most frequently requested colors, color approval ratings from previous clients, maintenance alerts such as low battery, low product in the cartridges, availability of updates, and other important notifications. For clients, access to the website or app allows them to submit reviews of their hair color, compare their previous colors, and "try on" new hair colors before receiving the hair dye. After a recent appointment, clients can upload images and reviews via a cloud coloring solution network of the hair color they received and provide details such as how accurate the color turned out compared to their desired color, how well the color is lasting, whether the color treatment has caused any damage or structural changes to their hair, and how the overall experience was. These reviews may be associated with the specific system of the present invention from which they received their hair coloring. This allows the clients and the hairstylists to track the performance of the present invention in comparison to other units of the same device.

Clients can choose for their reviews to remain private for their own records, or have their reviews uploaded to the cloud storage where their hairstylist(s) and the present invention can access the reviews and determine any changes that may be beneficial for the client's next appointment. Clients who choose to make their reviews accessible to the hairstylist and the present invention can have their data used and compared across clients in order to assist the stylist and the present invention in making informed decisions regarding a new client's hair. For example, one client with straight, thick, naturally dark hair may review their recent hair coloring as perfect and upload images of the completed new look. This information can then be used for a new client looking for the same new color with the same or similar baseline features. Based on the image and the review, the new client can choose to receive the exact same color mix, perfectly measured by the present invention to match the desired look previously achieved for the first client.

Furthermore, clients can upload images of their hair to the website or app in order to "try on" new hair colors prior to committing to a color for their appointment. The client can choose to adjust the shade of their current color or try completely different looks. Using augmented reality ("AR") technology, the client can select new hair colors and styles to try on their image. When a client finds a color they like, the information can be visually translated into a unique mix which is sent to the hairstylist and the present invention for their next appointment. Other data may be associated with the customer such as hair type, hair thickness, and previous hair dye experience, allowing the present invention to determine the exact ratios needed of each ingredient in order to produce the desired color for the client. All client and hairstylist data are stored and accessed via a cloud coloring solution network that interfaces with the present invention by way of connection to the PCB.

The network used and accessed by the present invention generally has an interconnection between other components of the system that enables communication between them for sharing data, such as client reviews and hairstylist input and instructions for creating hair colors stored in the cloud database. The present invention may furthermore connect with one or more servers and processors in order to execute several functions related to the computing tasks relevant to the present invention such as storing and accessing data, predicting desired changes based on client reviews and other data, and developing timelines for each client's hair color journey.

Some of these elements may or may not be present, depending on implementation and may act independently or be integrated with one another accordingly. The memory associated with the cloud network and used for the storage of data may also store software programs such as an operating system software and routines for execution by the present invention and/or accompanying processors. This memory may include read-only memory ("ROM"), nonvolatile writable memory such as flash memory, and static, dynamic, and/or magneto-resistive random-access memory ("SRAM", "DRM", "MRAM", respectively).

In the primary embodiment, the HPD may be powered by a rechargeable battery pack which gets its power from a detachable power cord which would preferably have USB to micro-USB or another standard format and can take voltage inputs from 110-240 v, allowing for the use of the present invention internationally. The purpose of utilizing a battery pack is so that the HPD can be placed anywhere even if there is not a power outlet nearby. In alternative embodiments, the present invention can be adapted to use standard outlets for power. The USB-C ports located on the present invention can also be used for the connection of data storage devices such as hard drives which allows hair stylists to backup any data associated with the device for future reference, although the data may also be uploaded and stored securely via a cloud database. Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The various embodiments are illustrated by way of example, and not by way of limitation, in the figures of the accompanying drawings. Having thus described the invention in general terms, reference will now be made to the accompanying drawings, which are not necessarily drawn to scale, and wherein:

FIGS. 5D-H show detailed diagrams of the features of the mechanism responsible for dispensing product from the hair pigment cartridges ("HPCs").

FIGS. 6A-E provide various angles of the interior and exterior of the present invention.

FIGS. 9A-J display the outer surfaces of the present invention from all angles.

FIGS. 12A-E show the carousel containing the hair pigment cartridges ("HPCs") in various positions in relation to the enclosure.

FIGS. 13A-B show the features of the mechanism responsible for rotating the carousel.

FIGS. 14A-B show the realignment mechanism of the carousel.

DETAILED DESCRIPTION OF THE PREFERRED EMBODIMENT

Figure 1:
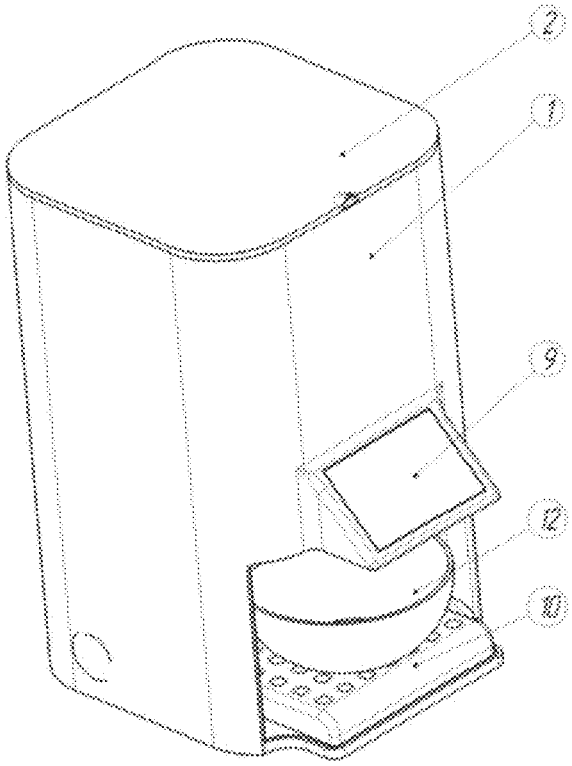
FIG. 1 is an overview of the Hair Pigment Dispenser ("HPD").

FIG. 1 shows a general overview of the Hair Pigment Dispenser ("HPD"). In accordance with the preferred embodiment of the present invention, the HPD consists of the enclosure 1, with attached lid 2, attached via a hinge 30. The lid 2 opens to provide access to the pigment cartridges and other components of the present invention, described in more detail in the following figures. Also attached to the enclosure 1 is the LCD 9. From the LCD 9, the hairstylist can interact with the present invention to select desired hair color, desired permanency, and provide other instructions to and receive notifications from the present invention. At the bottom of the enclosure is the bottom tray assembly 10, on which the bowl 12 is placed which receives the ingredients for a desired hair color mixture.

Figure 2:
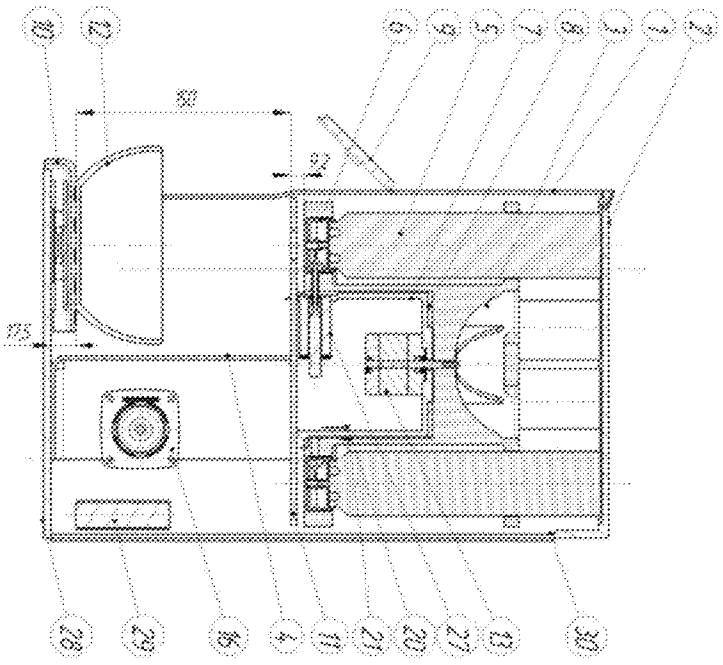
FIG. 2 is a sectional view of the Hair Pigment Dispenser ("HPD").

FIG. 2 provides a sectional view of the HPD and its innerworkings. In accordance with the preferred embodiment of the present invention, the inner compartment of the enclosure 1 with lid 2 contains the rotating tray 3 that holds the cartridges 5 and is powered by a stepper motor 13 to rotate in order to position the correct ingredient above the hair coloring bowl 12 which sits on bottom tray assembly 10. Once the correct cartridge 5 is in the correct dispensing position above the bowl 12, a magnet 21 of a linear stepper motor 27 is energized and pushes a pin 31 into the cap 6 of the cartridge 5 through a small opening which activates the valve inside the cartridge 5, allowing for the ingredient to dispense into the bowl 12.

To ensure that the bowl is in the correct position before dispensing any ingredients, a ZPI mechanism that could be a small magnet or other component capable of detecting position. In accordance with the preferred embodiment, a small magnet 20 acts as a position sensor in a fixed position that reads the ZPI or magnet when it is in close proximity. The software that powers the HPD can record the tray position when the sensor makes contact and label it as position Zero and use it as a reference so that the stepper motor 13 can perfectly position the tray in any target position for each ingredient to be dispensed. Tray 3 may also be removeable rather than fixed to the HPD so that it may be easily removed in order to switch the ingredients in use. For example, the hairstylist may remove the tray that holds oxidative HPCs and replace it with another tray already loaded with semi-permanent (direct) dyes rather than removing each cartridge one at a time.

Other components that provide structural support to the present invention are the frame 4, the support 7, the middle plate 11, and the bottom plate 28. Behind the frame 4 toward the backside of the enclosure is the speaker 16 which, along with the microphone 19, enable the present invention with several audio features. Voice command provides hairstylists with the advantage of controlling the present invention without using their hands and allows for increased multitasking thus decreasing the amount of time spent with each client, which for hair coloring appointments, can last several hours. On the backside of the enclosure 1 is the battery pack 29, which is accessible via the backside of the enclosure and provides power to the entire system. In accordance with the preferred embodiment, the battery pack 29 is removeable and rechargeable, which acquires power via a detachable power cord which is preferably a USB-C or other standard format that can take voltage inputs from 110-240V to enable it for use internationally.

Figure 3:
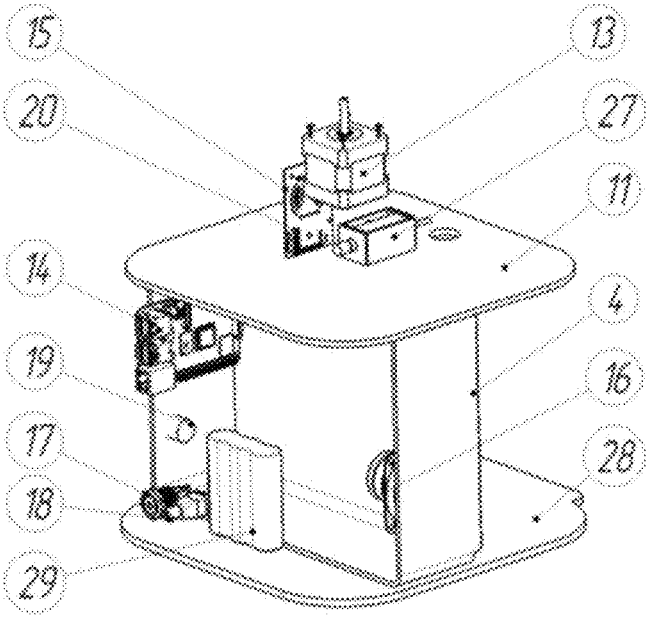
FIG. 3 provides the interior details of the Hair Pigment Dispenser ("HPD").

FIG. 3 provides the interior details of the HPD. In accordance with the preferred embodiment of the present invention, contained within the frame 4 and on top of or between the middle plate 11 and bottom plate 28 is an inner mechanism containing the cartridge RFID reader 15, the rotating stepper motor 13, and other components. The rotating stepper motor 13, RFID reader 15, position sensor 20, and linear stepper motor 27 are located on top of the middle plate 11. Between the middle plate 11 and the bottom plate 28, the controller 14, the microphone 19, the speaker 16, the power button 17, the power adapter (female) 18, and the battery pack 29.

Figure 4:
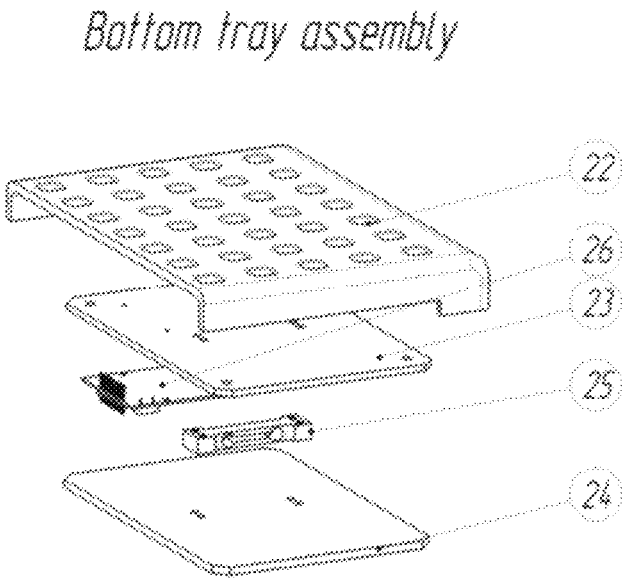
FIG. 4 shows the various attributes of the dispensing tray.

FIG. 4 shows the various attributes of the dispensing tray. In accordance with the preferred embodiment of the present invention, the dispensing tray has five components. The topmost portion of the dispensing tray is the plastic tray 22 which provides the surface on which the bowl 12 can be placed. The surface of the plastic tray 22 contains apertures to allow any prevent any potential spillage from collecting on the bottom of the mixing bowl 12. In alternative embodiments, the shape of the plastic tray 22 may be changed such that the sides of the tray curve upward in a bowl-like fashion to prevent over spillage and the bottom is a consistent, solid piece of plastic with no apertures. Underneath the plastic tray 22 is a metal tray 23 and the bowl QR code reader 26. Below the metal tray 23 and the QR code reader 26 is the scale 25 which measures the weight of the ingredients added to the bowl in order to provide the exact amount of each ingredient needed. Below the scale 25 is the bottom metal tray 24. Together, these pieces combine to form the tray on which the bowl 12 sits during the dispensing process.

Figure 5A:
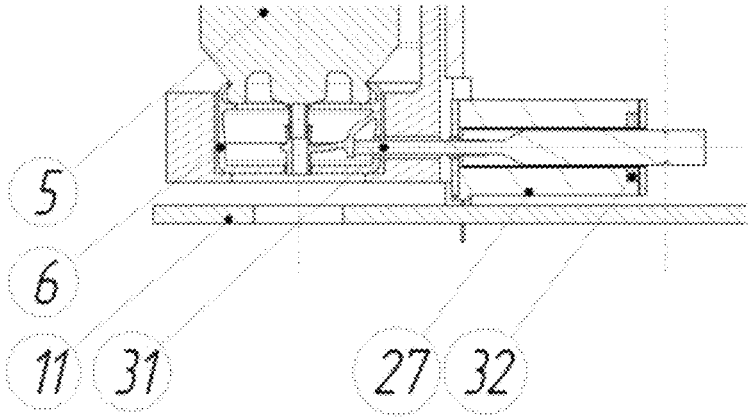
FIG. 5A is a diagram of the dispensing mechanism.

FIG. 5A is a diagram of the dispensing mechanism. In accordance with the preferred embodiment of the present invention, the dispensing mechanism consists of the desired cartridge 5, the cap of the cartridge 6, the pin 31, and the linear stepper motor 27. The dispensing mechanism is attached to the middle plate 11. Once a hairstylist has designated the desired output from the present invention, the cartridges required are selected and undergo the dispensing process in the exact measurements needed for the desired product. Once the correct cartridge 5 is in the correct dispensing position above the bowl 12, a magnet 21 of a linear stepper motor 27 is energized and pushes a pin 31 into the cap 6 of the cartridge 5 through a small opening which activates the valve inside the cartridge 5, allowing for the ingredient to dispense into the bowl 12.

Figure 5B:
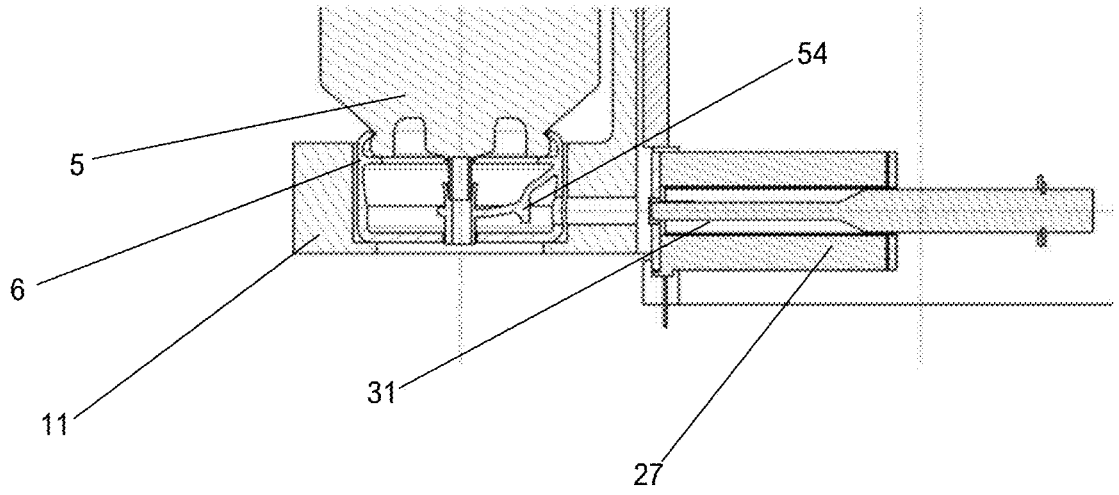
FIGS. 5B-C provide a visual of the dispensing mechanism in its non-dispensing state (5B) and dispensing state (5C).
Figure 5C:
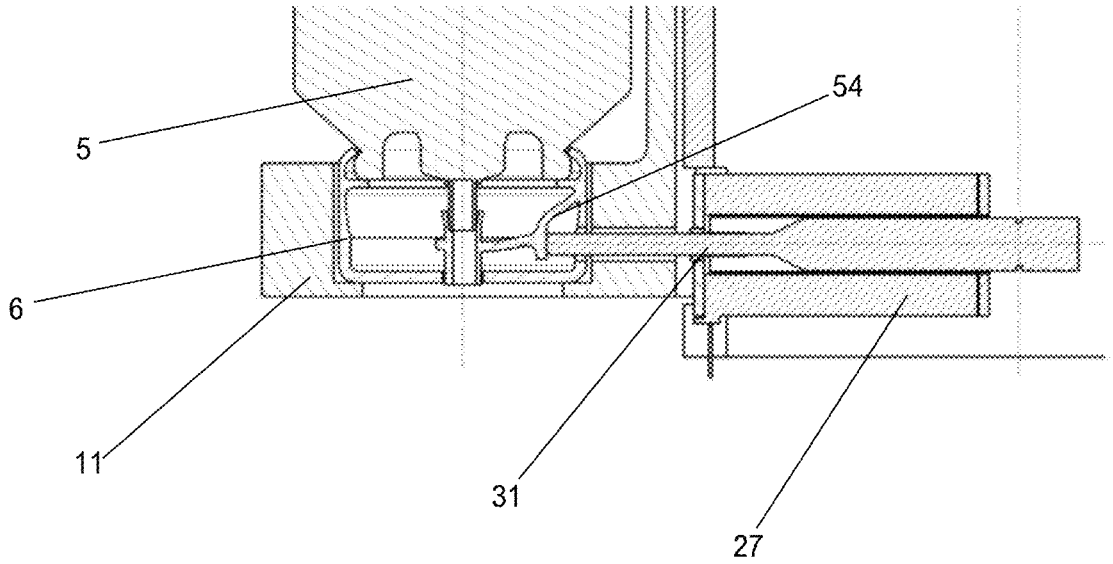
Figure 5H:
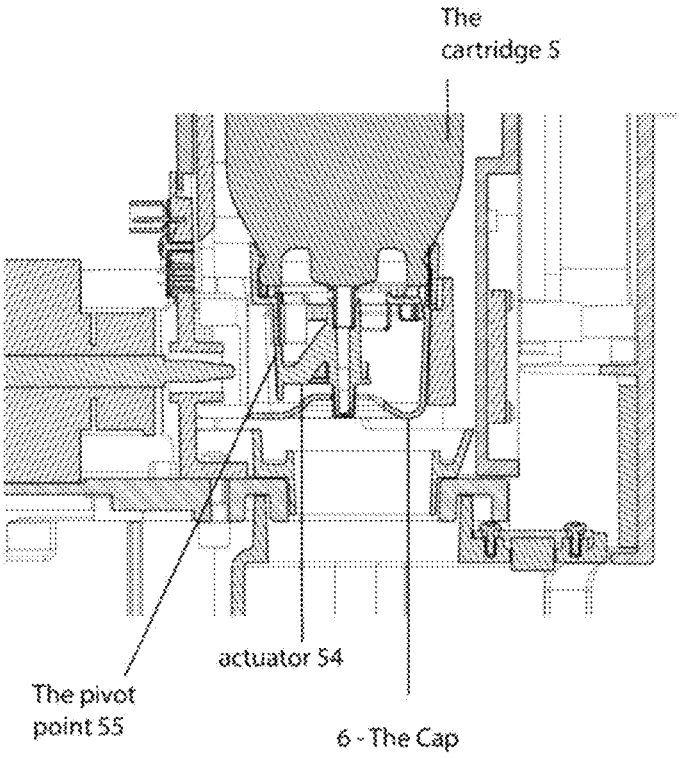

FIGS. 5B and 5C depict the dispensing mechanism of the present invention in both the not dispensing state (5B) and the dispensing state (5C). In accordance with the preferred embodiment of the present invention, the dispensing mechanism (which is attached to the middle plate 11) is in the not dispensing state when the pin 31 is in its resting position and has not been activated by the linear stepper motor 27. Since the pin has not been activated to push forward by the linear stepper motor, the cap 6 of the cartridge 5 remains closed, and no product is dispensed. The control PCB 38 may contain a microprocessor which interfaces with the linear stepper motor 27. When necessary, the PCB 38 and the associated microprocessor send electrical energy to the linear stepper motor, which converts rotary motion to linear movement which pushes the pin 31 forward into the cap 6. Once it is necessary for a cartridge to dispense product into the bowl 12, the linear stepper motor 27 activates the pin 31, pushing it through the designated opening and into the cartridge cap 6, where it pushes the actuator 54 which opens the cartridge and dispenses product into the bowl 12 below.

To dispense product from the cartridge, The linear stepper motor 27 converts the electrical input from the PCB 38 into mechanical energy by producing a magnetic field that propels the pin 31 of the linear stepper motor 27 forward into the cap 6. The pin 31 opens the valve by pushing the direction of force 56 on the pivot point 55 of an actuator 54. The actuator 54 converts the energy exerted by the pin 31 into mechanical energy that opens the valve of the cap 6, thus dispensing the product from the cartridge 5 until the scale 25 or load cell 46 in tray 3 reaches the desired weight of product and the flow of electrical energy from the PCB 38 is cut off If an RFID is not detected by the RFID reader 15 in the cap 6 of the cartridge 5 chosen to dispense product, the dispensing mechanism will not activate, and no product will be released.

FIGS. 5D-H show the features of the mechanism responsible for dispensing product from the HPCs 5. In accordance with the preferred embodiment of the present invention, a live hinge which is based at the pivot point 55 combines with the design of the actuator 54 in order to translate horizontal force applied by the pin 31 into vertical force pushing against the stem of the cartridge 5. This then opens the valve and dispenses the product from the HPC 5. To ensure correct alignment, the rotating tray 3 uses a realignment system. If, after optical alignment is achieved, the pin 31 is not already perfectly aligned with the actuator 54, the realignment system within the carousel 51 will channel the pin 31 into the correct position of the cap 6 thus preventing the pin 31 from getting stuck against the cap 6.

FIGS. 6A-E provide various angles of the interior and exterior of the present invention. In accordance with the preferred embodiment of the present invention, the lid 2 is attached to top of the enclosure 1 and the plastic tray 22 is attached to the enclosure 1 at the bottom. On the front side of the present invention, the logo illumination PCB 35, and the RFID reader 15 are located and labeled in FIG. 6A. Atop the plastic tray 22, the bowl 12 may rest, and its presence can be detected by the QR code reader 26. Inside the enclosure, a carousel of the HPCs 5 is located which is capable of rotating in order to position the desired HPC 5 in the dispensing position. FIG. 6A provides a view of the interior of the present invention from a diagonal angle. From this point of view, the frame 4 is shown which provides structural support to the interior features. Also shown are the HPCs 5 with the associated caps 6 attached at the bottom of each cartridge. Below the caps 6 of the HPCs 5 and above the middle plate 11 is the drip tray 41 which catches any unexpected drops of hair pigment should any of the caps develop a leak. Also shown from this point of view is the base 25 of the present invention and the plastic tray 22 on top of which the bowl 12 sits. On the backside of the enclosure 1, the battery pack 18 is shown. On the bottom of the present invention, the speaker 16 and the PCB 38 are shown.

Figure 7:
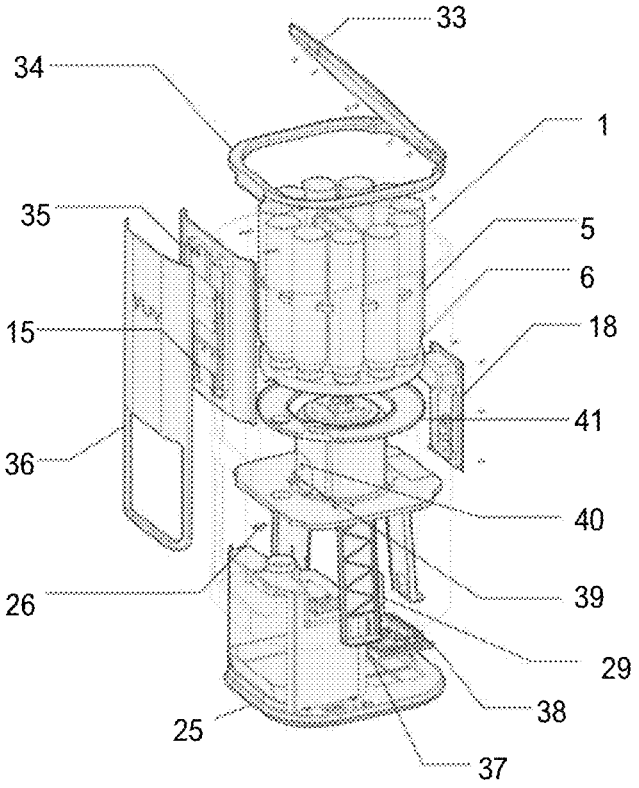
FIG. 7 provides a visual of the details of the present invention.

FIG. 7 provides a visual of the details of the present invention. In accordance with the preferred embodiment of the present invention, the lid 2 is secured closed via a magnetic clasp Any opening of the lid is detected by the lid opening sensor 33. The front-facing portion of the enclosure 1 displays the logo of the present invention and contains a logo illumination PCB Located near the logo illumination PCB is the RFID reader 15. The enclosure 1 also consists of a high gloss panel 36 where the LCD touchscreen 9 is located. The QR code camera 26 is located in a position that allows it to scan for the QR code located on the bowl 12. The present invention is also enabled with Bluetooth connectivity via a Bluetooth connection device 37. The "brain" of the present invention is contained in a main printed circuit board ("PCB") 38, located near the rechargeable battery pack 29 and the Bluetooth connection device 37.

The PCB 38 provides the present invention with internet connectivity and allows for the storage of data in internal, external, or cloud databases. Data such as client reviews, previously mixed colors, and instructional input from the hairstylist may be stored and referenced by the present invention to optimize the overall future experience for both the hairstylist and the clients. The PCB 38 also allows the present invention to receive software updates to improve the overall experience when needed. The hairstylists can also remotely calibrate the present invention via an app or website profile connected to the present invention, as well as receive notifications and alerts related to the status of the present invention such as low battery, low product quantity, or other necessary messages. The entire dispensing mechanism 39 is located centrally within the present invention as shown in previous figures. An optical sensor 40 is located on the dispensing mechanism. The drip tray 41 collects any potential spills or leaks from the cartridges, preventing any damage to the mechanics. The USB-C ports 18 are shown on the backside of the enclosure to provide charging to the rechargeable battery pack which is preferably a lithium battery pack. The RFID-containing cartridge cap 6 is shown on each cartridge 5 within the present invention.

Figure 8:
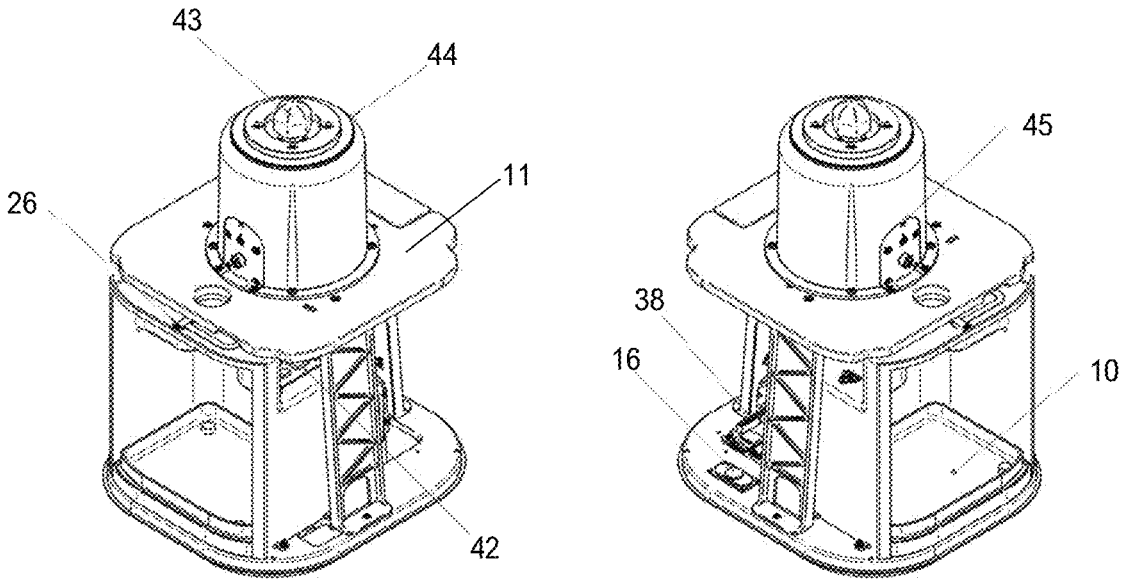
FIG. 8 is a detailed outline of the base assembly of the present invention.

FIG. 8 is a detailed outline of the base assembly of the present invention. In accordance with the preferred embodiment of the present invention, the base portion of the HPD includes several technical aspects such as the QR code-scanning camera 26, the speaker 16, the camera PCB 42, the light sensor 45, and the control PCB 38. The QR code-scanning camera 26 is embedded in the base of the present invention and scans for the QR code located on the bowl associated with the present invention to ensure that it is in the correct position prior to dispensing any product. The use of QR codes allows for each bowl used to maintain a unique function. For example, it may be useful to use one bowl for mixing lighter hair colors, and another for darker colors, or likewise, to use one bowl for permanent dye mixes and another for semi-permanent or demi-permanent hair dyes. In this way, the use of QR codes allows the hairstylists to use a unique organization and categorization system for the mixed dyes. The camera PCB 42 can connect and share data with the control PCB 38 regarding the QR code scanned. For example, a hairstylist may have a unique bowl for each client. By sharing data regarding the client and their unique bowl, the camera PCB 42 can determine which color to mix based on the QR code it scans as this QR code has become associated with a specific client's data.

The speaker 16 allows the present invention to interact with voice commands and provide alert and notification sounds when enabled. The light sensor 45 adjusts the lighting of the logo on the front-facing portion of the present invention, providing the ability of dimming the light as well as having certain light colors, patterns, or brightness indicate various states of the present invention. The base of the present invention is also assembled with several necessary structural components that enable the mechanics to function such as the hex adapter 43, the bearing 44, and bottom tray assembly 10. The hex adapter 43 and the bearing 44 assist in the rotation of the carousel 51, allowing for smooth turning each time a new cartridge is selected to be dispensed. FIGS. 9A-J display the outer surfaces of the present invention from all angles. In accordance with the preferred embodiment of the present invention, the base portion of the present invention may be detached from the enclosure 1 for general maintenance. Lid 2 may open and remain attached to the enclosure 1 by way of a hinge 30, to allow for easy access to the cartridges for their maintenance and replacement. FIGS. 9A-D provide views of the enclosure and the bottom of the base portion of the present invention. FIG. 9B provides a view of the entire bottom of the base. FIGS. 9A and 9C provide the backside view, and FIG. 9D provides the front-facing view. FIGS. 9E-G provide straight-on back, profile, and front views of the enclosure 1. FIG. 9H provides a birds-eye-view of the lid 2 of the present invention. FIGS. 9J-I provide top-down views of the enclosure 1.

Figure 10A:
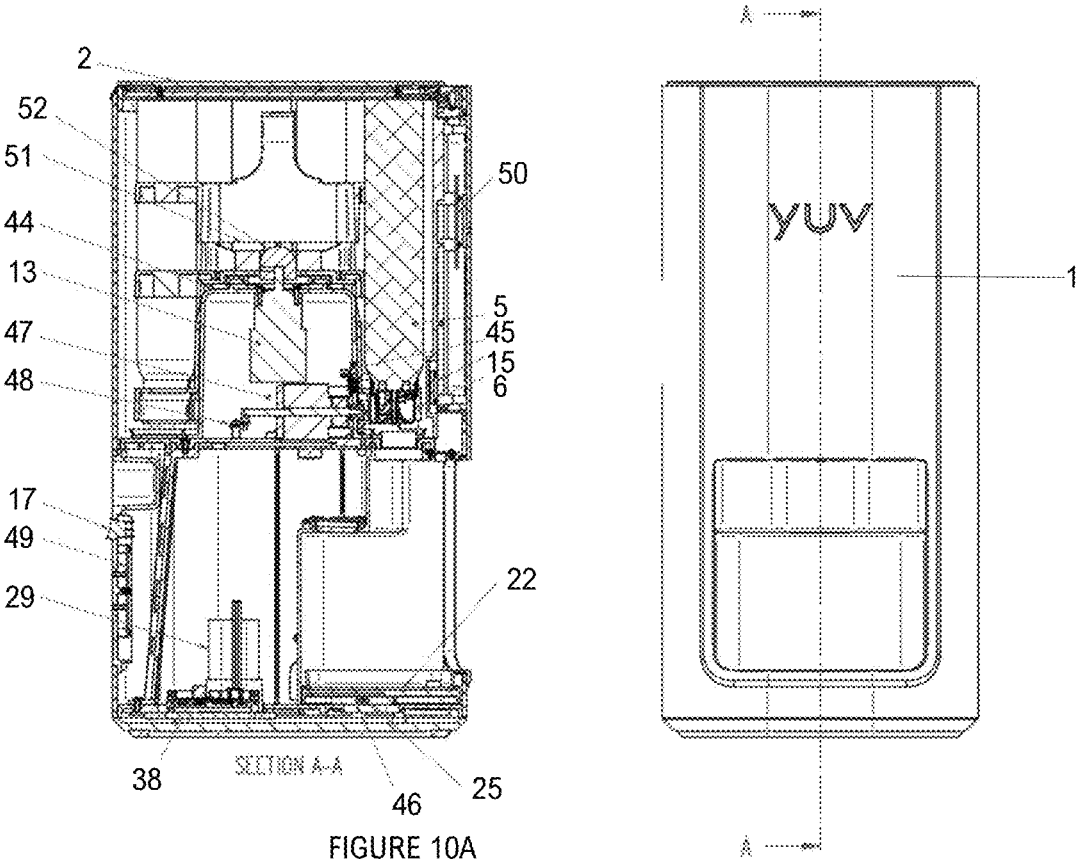
FIG. 10A is a cross-sectional view of the present invention along plane A.

FIG. 10A is a cross-sectional view of the present invention along plane A. In accordance with the preferred embodiment of the present invention, a hex drive 52 is implemented along with the stepper motor 13, the actuator sensor 48, and a linear motor 47 in order to rotate the carousel 51 and dispense the contents of the cartridges. The actuator sensor 48 converts electrical energy supplied by the power PCB 49 into physical energy exerted through the linear motor 47 which converts horizontal motion into vertical motion in order to open the cap 6 of the desired cartridge 5. In order to position the desired cartridge in the dispensing position, the stepper motor 13 rotates the carousel 51 with assistance from the hex drive 52 and the bearing 44. To ensure that the cartridge in use is associated with the present invention, the RFID reader 15 is positioned so that it may scan each cartridge as it passes the dispensing position.

Within the bottom tray assembly 10 and underneath the plastic tray 22, a load cell 46 or scale 25 is located which measures the mechanical force of the bowl as it collects the dispensed products and translates this into the weight for accurate measurement of each ingredient. Behind the front-facing portion of the enclosure 1 is the light PCB 50 which provides electrical power to the LED light found behind the translucent logo design and the light sensor 45. On the backside of the enclosure 1, the power switch or button 17 is located near the power PCB 49, the battery pack 29, and the control PCB 38. All mechanical features related to power are conveniently located on the bottom portion behind the dispensing zone which is easily accessed when the base-portion of the present invention is removed from the outer enclosure 1.

Figure 10B:
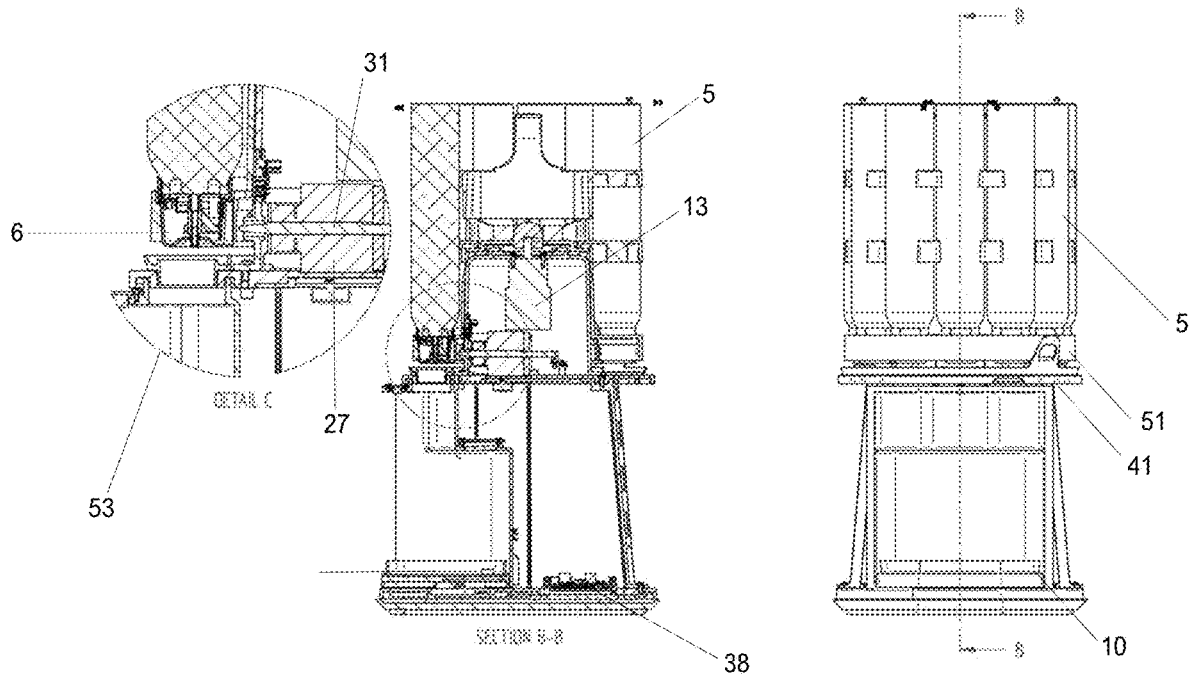
FIG. 10B is a cross-sectional view of the present invention along plane B with detailed image C.

FIG. 10B is a cross-sectional view of the present invention along plane B with detailed image C. In accordance with the preferred embodiment of the present invention, the cartridges 5 are loaded into the present invention from the top when lid 2 is opened. These cartridges are organized in a circular fashion, so that they may rotate in the carousel 51 to position the required cartridge in the dispensing position above the bowl which is placed in the open space above the bottom tray assembly 10 seen in the section B-B of FIG. 10B. The dispensing mechanism is outlined in Detail C. This mechanism includes the stepper motor 13, linear motor 47, hex drive 52, hex adapter 43, pin 31, RFID-containing cap 6, cartridges 5, RFID reader 15, linear stepper motor 27, pin 31, actuator 54, and the control PCB 38.

Figure 11:
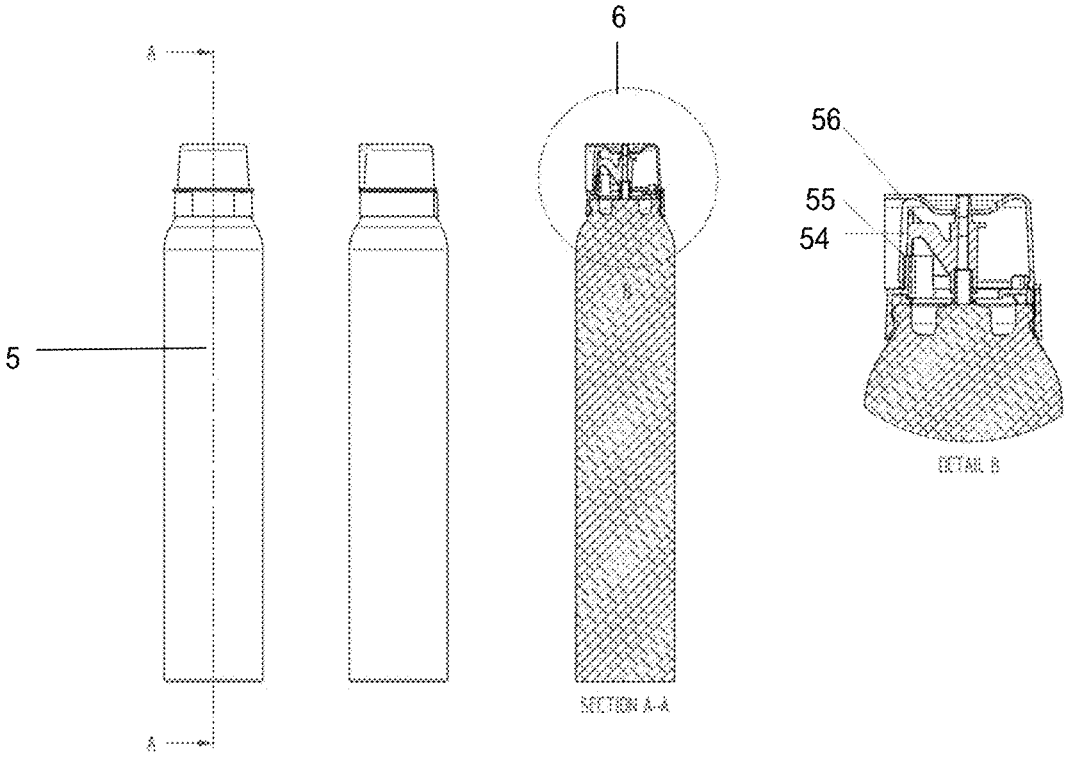
FIG. 11 is a cross-sectional view of the cartridges associated with the present invention along plane A with detailed image B.

FIG. 11 is a cross-sectional view of the RFID-containing cap 6 and cartridges 5 associated with the present invention along plane A with detailed image B. In accordance with the preferred embodiment of the present invention, each cartridge 5 and its associated RFID-containing cap 6 are unique in their association with the present invention. That is, not just any cartridge can be used in place of those associated with the present invention due to the RFID-containing cap and the RFID reader located inside the present invention. Furthermore, the RFID associated with each cartridge act as a label for the product contained within the cartridge to ensure the correct product is being dispensed. If the cartridge is low on product, this is communicated to the PCB 38 via the RFID associated with the low cartridge.

To dispense product from the cartridge, The PCB 38 receives instructions from the hairstylist either directly inputted to the present invention or sent via Bluetooth or cloud software from the hairstylist's wireless device. If the bowl 12 is detected by the QR code-scanning camera 26 in the dispensing position, the PCB sends electrical current to the linear stepper motor 27 adjacent to the cap 6. The linear stepper motor 27 converts the electrical input into mechanical energy by producing a magnetic field that propels the pin 31 of the linear stepper motor 27 forward into the cap 6. The pin opens the valve by pushing the direction of force 56 on the pivot point 55 of an actuator 54. The actuator 54 converts the energy exerted by the pin 31 into mechanical energy that opens the valve of the cap 6, thus dispensing the product from the cartridge 5 until the scale 25 or load cell 46 in tray 3 reaches the desired weight of product and the flow of electrical energy from the PCB 38 is cut off. If an RFID is not detected by the RFID reader 15 in the cap 6 of the cartridge 5 chosen to dispense product, the dispensing mechanism will not activate, and no product will be released.

Figure 12E:
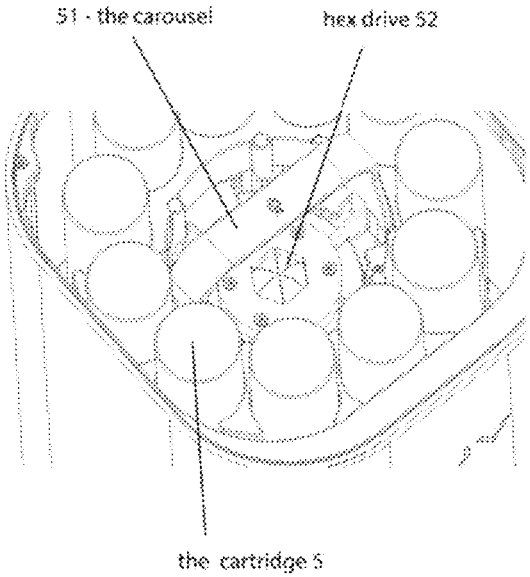

FIGS. 12A-E show the carousel containing the HPCs in various positions in relation to the enclosure. In accordance with the preferred embodiment of the present invention, the HPCs 5 are secured on a carousel 51 which is capable of rotating in order to position the correct HPC 5 in the dispensing position. The carousel 51 containing the cartridges 5 is removable from the enclosure 1 and may be lifted by its handle out of the top of the enclosure 1 when the lid 2 is in the opened position. FIG. 12A shows the carousel 51 containing HPCs 5 as it appears when it is fully removed from the enclosure 1 of the present invention. FIG. 12B shows the carousel 51 in relation to the enclosure 1 and lid 2. FIG. 12C shows the carousel 51 as it is removed or inserted into the enclosure 1. FIG. 12D provides an alternative view of the carousel 51 as it is removed or inserted into the enclosure 1. In FIG. 12E, the handle of the carousel 51 can be seen in the center of the circle of HPCs 5. This handle allows the carousel 51 to be easily removed from and inserted into the enclosure 1. Below the handle of the carousel 51 is the hex drive 52 which is one piece of the mechanism responsible for rotating the carousel 51.

FIGS. 13A-B show the features of the mechanism responsible for rotating the carousel. In accordance with the preferred embodiment of the present invention, the center of the carousel 51 contains the rotation mechanism consisting of the hex drive 52, the bearing 44, and the stepper motor 13. The stepper motor 13 is activated when it receives an electrical signal from at least one of the plurality of PCBs. The stepper motor 13 is then pushed upward into the opening of the hex drive 52 to turn the hex drive 52 which rotates the carousel 51. This mechanism is held in place by the bearing 44. The curved, smooth and key-shaped design of the hex drive 52 makes it easy for the carousel 51 to be placed in the correct position as it guides the matching key-shape of the carousel into place allowing for some initial tolerance. The compact size and shape of the carousel 51 and enclosure 1 prevent any potential misalignment with the hex drive 52. FIG. 12A shows the stepper motor 13 in the rotating position in which is it inserted into the hex drive 52. FIG. 12B shows the stepper motor 13 in the disengaged position, in which it is not associated with the hex drive 52.

FIGS. 14A-B show the realignment mechanism of the carousel. In accordance with the preferred embodiment of the present invention, the carousel 51 contains a realignment section which ensures that the pin 31 is perfectly aligned with the cap 6 of the cartridge 5 so that the pin 31 may open the valve that releases product from the cartridge without getting stuck elsewhere in the cap 6. The pin 31 is pushed forward in a precise manner by the linear stepper motor 27, which can control the speed at which the pin 31 is pushed into the cap 6. If the realignment section of the carousel 51 does not detect that the pin 31 and the cap 6 are perfectly aligned, the linear stepper motor will not be engaged, and the pin will not be pushed forward until the correct alignment is achieved. If the alignment is off, the stepper motor 13 which rotates the carousel via the hex drive 52 will continue to rotate the carousel in small increments until the alignment is detected. FIG. 14A provides a bottom-up view of the carousel 51, the caps 6 of the cartridges 5, the rotating mechanism including the stepper motor 13, hex drive 52, and bearing 44. FIG. 14B shows a close-up diagram of a cap 6 in the realignment section of the carousel 51 where the pin 31 is aligned with the cap 6 for dispensing.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that may be included in the disclosed technology. The disclosed technology is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the technology disclosed herein. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

What is claimed is:

1. An apparatus for dispensing hair product into a receptacle comprising:

a. at least one cartridge containing hair product, said cartridges comprising a cap and a valve;

b. said receptacle formed for receiving dispensed hair product from said cartridge;

c. a scale capable of weighing said receptacle and said dispensed hair product;

d. at least one computer-controlled dispensing mechanism for dispensing said hair product as controlled by a first computing device, wherein said computer-controlled dispensing mechanism further comprises:

i. a pin actuating motor;

ii. a pin controlled by said pin actuating motor;

iii. an actuator capable of opening said valve when pressure is applied to said actuator by said pin;

iv. said valve opening to dispense said hair product from said cartridge; and

V. an alignment mechanism capable of aligning said pin with said cap of said cartridge; and vi. a plurality of computing devices each including a processor and memory, for:

1. receiving data related to previous hair product requests from a plurality of independent user interfaces;

2. receiving instructions from said plurality of independent user interfaces for hair product requests;

3. sending data related to previous hair product requests to a plurality of independent user interfaces;

4. storing data related to previous hair product requests; and 5. operating said at least one computer-controlled dispensing mechanism in response to data from said scale while activating and deactivating said computer-controlled dispensing mechanism to release said hair product in an amount directed by a formula for a desired product.

2. The apparatus of claim 1, wherein said plurality of computing devices are enabled with Internet and Bluetooth connections for interaction with a plurality of said users.

3. The apparatus of claim 1, wherein said cap of said cartridge contains a radiofrequency identification ("RFID") tag.

4. The apparatus of claim 1, wherein said hair product dispenser is enabled with at least one RFID scanner capable of detecting said RFID tag in said cap of said cartridge.

5. The apparatus of claim 1, wherein said scale confirms that said hair product is added to said receptacle in the amount required by said formula.

6. The apparatus of claim 1, wherein said hair product dispenser further comprises an independent user interface capable of enabling a user to select a desired hair product and requesting said desired hair product from said hair product dispenser.

7. The apparatus of claim 1, wherein said receptacle contains a unique quick response ("QR") code.

8. The apparatus of claim 7, wherein said hair product dispenser is enabled with a camera capable of scanning said unique QR code on said receptacle.

9. A method for dispensing hair product from a hair product dispenser, said method comprising:

a. at least one cartridge containing hair product, said cartridge comprising a cap and a valve;

b. a receptacle formed for receiving dispensed hair product from said cartridge;

c. a scale for weighing said receptacle and said dispensed hair product;

d. at least one computer-controlled dispensing mechanism for dispensing said hair product as controlled by a first computing device, wherein said computer-controlled dispensing mechanism further comprises:

i. a pin actuating motor;

ii. a pin controlled by said pin actuating motor;

iii. an actuator capable of opening said valve when pressure is applied to said actuator by said pin;

iv. said valve opening to dispense said hair product from said cartridge; and v. an alignment mechanism capable of aligning said pin with said cap of said cartridge; and vi. a plurality of computing devices each including a processor and memory, for:

1. receiving data related to previous hair product requests from a plurality of independent user interfaces;

2. receiving instructions from said plurality of independent user interfaces for hair product requests;

3. sending data related to previous hair product requests to a plurality of independent user interfaces;

4. storing data related to previous hair product requests; and 5. operating said at least one computer-controlled dispensing mechanism in response to data from said scale while controlling said computer-controlled dispensing mechanisms to release said hair product in an amount directed by a formula for a desired product.

10. The method of claim 9, wherein said receptacle contains a unique quick response ("QR") code.

11. The method of claim 9, wherein said hair product dispenser is enabled with a camera capable of scanning said unique QR code on said receptacle.

12. The method of claim 9, wherein said cap of said cartridge contains a radiofrequency identification ("RFID") tag.

13. The method of claim 9, wherein said hair product dispenser is enabled with at least one RFID scanner capable of detecting said RFID tags in said cap of said cartridge.

14. An apparatus for enabling a hair product dispenser to dispense, receive, and execute requests for hair product, comprising:

a. said hair product dispenser enabled for receiving a request from one or more of a plurality of independent user interfaces;

b. a plurality of printed circuit boards ("PCBs") of which at least one is enabled to activate a dispensing mechanism, said dispensing mechanism comprising:

i. a pin actuating motor enabled to push a pin into a cap of a cartridge containing hair product;

ii. said pin enabled to open a valve of said cap of said cartridge by way of pressure application to an actuator;

iii. said cartridge dispensing hair product into a receptacle;

iv. a scale on top of which said receptacle is located, said scale configured to weigh the contents of said receptacle;

v. said scale connecting with at least one of said plurality of PCBs; and vi. said PCBs controlling said pin actuating motor to prevent further dispensing of said hair product into said receptacle upon detection of a correct weight of said hair product in said receptacle.

15. The apparatus of claim 14, wherein at least one of said plurality of PCBs is enabled with Internet and Bluetooth connections for interaction with a plurality of said independent user interfaces.

16. The apparatus of claim 14, wherein said plurality of independent user interfaces may be personal wireless devices enabled with Internet and Bluetooth.

* * * * *